United States Patent [19]

Neumann et al.

[11] Patent Number: 4,624,712

[45] Date of Patent: Nov. 25, 1986

[54] STOVEPIPE CLEANING APPARATUS ARRANGEMENT AND METHOD

[76] Inventors: Eugene P. Neumann; Eleanore R. Neumann, both of Rte. 1, Box 90, Glidden, Wis. 54527

[21] Appl. No.: 642,082

[22] Filed: Aug. 20, 1984

[51] Int. Cl.[4] ..... A46B 13/08; B08B 9/06; F23J 3/02

[52] U.S. Cl. ..... 134/8; 134/24; 15/162; 15/242

[58] Field of Search ..... 134/8, 24, 167 R, 167 C; 15/162, 242

[56] References Cited

U.S. PATENT DOCUMENTS

| | | | |
|---|---|---|---|
| 91,608 | 6/1869 | Cook | 15/249 |
| 539,391 | 5/1895 | Newman | 126/307 R |
| 1,271,656 | 7/1918 | Blauvelt et al. | 15/242 |
| 1,338,917 | 5/1920 | Hall | 15/162 |
| 1,528,252 | 3/1925 | House | 285/127 |
| 2,236,123 | 3/1941 | Von Pierce | 15/242 |
| 4,377,015 | 3/1983 | Baugh | 15/162 |

FOREIGN PATENT DOCUMENTS

| | | | |
|---|---|---|---|
| 577341 | 5/1946 | United Kingdom | 15/162 |

*Primary Examiner*—Ernest G. Therkorn
*Attorney, Agent, or Firm*—Robert C. Baker

[57] ABSTRACT

An economical stovepipe cleaning apparatus arrangement comprising a T-shaped stovepipe joint which is connected to two transversely oriented stovepipes of a combustion stove. The joint has an opening with a readily removable cover to be removed for permitting attachment of a bag and brush assembly to the opening of the joint for cleaning. The arrangement provides a fast, convenient and dust-free method of brush-cleaning the stovepipes without a need for any disassembly of the conduiting of the stovepipes.

4 Claims, 6 Drawing Figures

STOVEPIPE CLEANING APPARATUS ARRANGEMENT AND METHOD

BACKGROUND OF THE INVENTION

The present invention relates to an economical stovepipe cleaning apparatus arrangement and a method of using such arrangement. More particularly, the invention relates to a T-shaped stovepipe joint which is connected to two transversely oriented stovepipes of a combustion stove. A wholly removable bag and brush assembly is adapted to be attached to an opening in the joint for cleaning. A cap is provided for closing the opening when the assembly is removed during times of combustion.

In multiple-story buildings, stovepipe conduiting used in combustion or firebox stoves often has elbows or 90° joints to direct smoke and combustion wastes horizontally through an outer wall or into a chimney to the outside environment. A common problem that occurs in all stovepipes, more particularly in horizontal stovepipes, is that they often become places for accumulation of combustion wastes, such as soot, ashes, creosote and dust. Such accumulation may actually plug up stovepipes. Complicating this problem is the fact that such wastes are still further combustible. Therefore, periodic and thorough cleaning to remove such wastes is mandatory to prevent the possibility of fires within the stovepipes themselves. Such fires are commonly known as "chimney fires" and can be very deadly and destructive.

Cleaning such potential fire hazards from the pipes is a very unpleasant, messy job. Freed air-borne soot, dust and waste particles are highly undesirable within a room's atmosphere. Heretofore all known attempts at performing this task have dealt with some degree of disassembly of the stovepipe conduiting, or adding complex conduiting structures, or stationing a permanent scrubbing brush (which becomes a fire hazard when filled with soot) within the stovepipe conduiting.

SUMMARY OF THE INVENTION

The present invention provides a stovepipe cleaning apparatus arrangement for a combustion stove having stovepipes for carrying away wastes and a method for using such arrangement. The arrangement requires no disassembly of the stovepipe conduiting for cleaning.

Further provided is an arrangement whereby all wastes particles freed during cleaning settle and fall into either the lower chamber of the stove, such as a firebox or ash drawer, or inside the chimney base from which the soot and dust may easily be removed.

Still further provided is an arrangement that is of an economical and simple construction and permits a fast, convenient and dust-free method of brush cleaning stovepipes, thus diminishing the chance of chimney fires.

In the present invention, a T-shaped stovepipe joint is connected in the stovepipe conduiting of a combustion or firebox stove. An opening in the T-shaped stovepipe joint has a readily removable cap which is removed for attachment of a bag and brush assembly for cleaning. The bag and brush assembly comprises a stovepipe cleaning brush with an attached shaft and a pliable bag just sufficiently large to envelop the brush. The shaft is slidably received in a close-fitting aperture of the bag. Opposing the aperture in the bag is an elastic mouth.

Between the aperture and the mouth, the bag is symetrical.

The T-shaped stovepipe joint is placed at the juncture of a vertical stovepipe from a combustion stove and a horizontal stovepipe. It replaces the normal elbow or 90° joint at that juncture. The readily removable cap over the remaining third opening prevents exhaust and wastes from entering the room during times of combustion within the stove, and yet still provides easy access to the inside of both the vertical and horizontal stovepipes at cleaning time.

The bag provides an envelope about the brush when not in use. This envelope catches or confines any wastes which may drop off the brush during storage. The elastic of the mouth of the bag serves as a fastening means. At cleaning time when the cap is removed, the mouth is expanded and slid over the opening of the joint to snugly fit and seal over the opening so as to block the exit of soot and dust from the stovepipe conduiting. When the assembly is so attached for cleaning operations, the mouth is opened wide enough to permit the brush to pass therethrough into the conduiting.

The shaft may serve as a handle to move the brush into the conduiting and for actuating the scrubbing motion of the brush as necessary for cleaning. The close-fitting aperture about the shaft blocks passage of soot and dust therethrough. The pliable nature of the bag together with sealing arrangements of the mouth and aperture permit the flexible shaft to scrub either the vertical or horizontal stovepipes while yet blocking exit of soot and dust.

With the forgoing apparatus arrangement, a new method is provided for cleaning stovepipes wherein attachment of the bag and brush assembly to the stovepipe joint and its operation, without any disassembly of the stovepipe conduiting, comprise the key steps.

DETAILED DESCRIPTION OF THE PREFERRED EMBODIMENT

Figure 1:
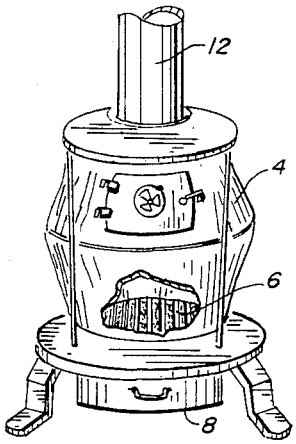
FIG. 1 is a front elevational view of a combustion stove and stovepipe conduiting according to the invention.

Referring to FIG. 1, a conventional combustion or firebox stove 4 is shown with its firebox 6 partially cut away and an ash drawer 8 therebelow. A vertical stovepipe 12 for carrying smoke and wastes upwardly out of stove 4 typically has its lower opening connected to the firebox 6 near the top of the stove 4.

Figure 2:
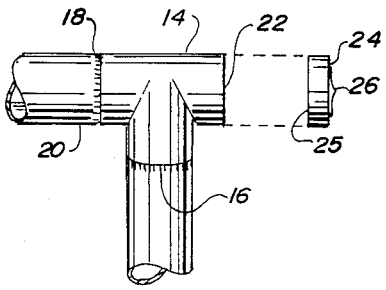
FIG. 2 is a front elevation of a T-shaped stovepipe joint.
Figure 2:
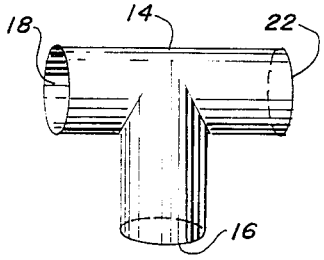

A T-shaped stovepipe joint 14 (FIGS. 1 and 2), which is made out of sheet metal, or equivalent, has first, second and third openings 16, 18 and 22. The bottom or first opening 16 is connected to vertical stovepipe 12. The top second opening 18 is connected to a horizontal stovepipe 20 which suitably empties through a wall or chimney to the outside atmosphere. The top third opening 22 provides easy access to the interior of the transversely oriented stovepipes 12 and 20. A readily removable cap 24, similarly made of sheet metal, has a lip 25 on its perimeter for sliding over the top third opening 22 of joint 14 to thereby seal in smoke and wastes during times of combustion within stove 4. Cap 24 may additionally have a handle 26 and may be securely fastened to joint 14 by sheet metal screws, if desired.

Figure 4:
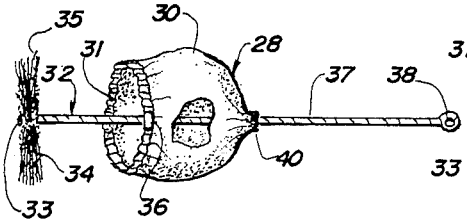
FIG. 4 is a side elevation of the bag and brush assembly, partially cut away, with the mouth expanded and the brush extending therethrough and out of the bag.
Figure 3:
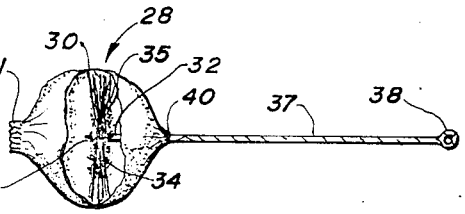
FIG. 3 is a side elevation of a bag and brush assembly partially cut away.

Generally referring to FIGS. 3 and 4, a bag and brush assembly 28 includes a brush apparatus 32 having a brush 34 with wire bristles 35 (or equivalent bristles, even possibly those of plastic) radiating outwardly from its center 33, and an attached flexible shaft 37. Wire bristles 35 provide a scrubbing means for cleaning the dust, ashes, soot, creosote and other particles built up on the inside walls of joint 14 and stovepipes 12 and 20. Shaft 37 may itself be employed as a handle or be equipped with a handle 38 to provide a grip for effecting reciprocating and rotating action of the brush apparatus 32 during cleaning. Shaft 37 is preferably made of a flexible twisted wire, or the like, so that it will bend and allow wire brush 34 to be inserted into either the horizontal or vertical stovepipes 12 and 20 while shaft 37 extends out of opening 22.

A bag 30, preferably made of a pliable material, such as canvas or cloth, is appropriately large enough to envelop brush 34 but is not a soot and dust collection container. It is preferably just sufficiently large to accommodate the brush 34 and serve as an envelope around it. As shown in FIG. 3, bag 30 has an elastic constraining mouth 31 which is substantially closed when the assembly is not in use so that the bag confines and catches any soot and dust that may fall off brush 34 during storage. As shown in FIG. 4, mouth 31 may be expanded to various suitable diameters to accommodate and attach to stovepipes of varying diameters such as the standard 6 and 8 inch types. Opposing mouth 31 in bag 30 is an aperture 40 which closely fits about and slidably receives shaft 37. The close-fitting aperture 40 may be made of elastic material to keep it tightly fitted about movable shaft 37. Between the mouth 31 and aperture 40, the bag 30 is symmetrical in that the lengths of any and all longitudinal wall segments of the bag between the mouth and aperture are substantially equal.

At the time of attachment of bag 30 to opening 22, mouth 31 is open wide enough to allow brush 34 to pass out of bag 30 into the conduiting of stovepipes 12 or 20 for scrubbing. Additional tightening means 36, such as snaps or velcro pads, may be added onto the periphery of mouth 31. The pliable material of bag 30 permits it to flex and allow aperture 40 to accommodate the varying positions of flexible shaft 37 during the scrubbing of either transversely oriented stovepipes 12 or 20. At all times, the bag 30 blocks the exit of any soot or dust from the stovepipe conduiting during cleaning.

Figure 5:
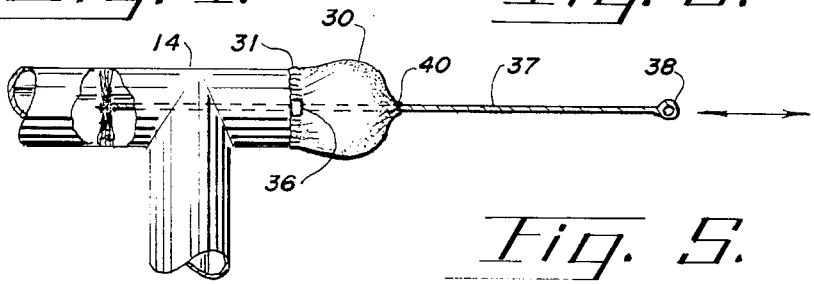
FIG. 5 is an operational view of the stovepipe cleaning apparatus arrangement of the invention cleaning a horizontal stovepipe.

In operation, after a fire in the firebox 6 is allowed to go out or has diminished to the point where the stovepipes 12 and 20 are only modestly warm to the touch, any residual hot embers are moved out of the path of where soot and dust may fall from a stovepipe undergoing cleaning. Cap 24 is removed from joint 14. As shown in FIG. 5, mouth 31 of cloth bag 30 is then expanded by hand and slid over the third opening 22 of joint 14. Snaps 36 may then be fastened to more firmly secure mouth 31 in place. A tight fitting seal between the mouth 31 of bag 30 and pipe joint 14 is formed. The handle 38 of shaft 37 is then grasped by the operator and is pushed toward aperture 40 to thereby move wire brush 34 into pipe joint 14 and into horizontal stovepipe 20.

Shaft 37 is moved with a reciprocating and rotational push-pull stroke cycle to scrub the insides of pipe joint 14 and horizontal stovepipe 20 with wire brush 34. During the push stroke of shaft 37, waste particles are moved into a chimney hole at the end of horizontal stovepipe 20 and allowed to settle and fall down inside the chimney to its base. During the pull stroke of shaft 37, the waste particles are moved into vertical stovepipe 12 and allowed to settle and fall down into firebox 6 or ash drawer 8.

Figure 6:
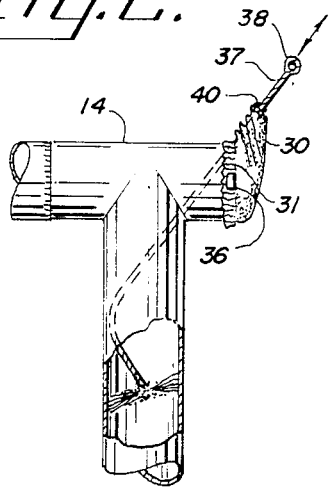
FIG. 6 is another operation view of the apparatus arrangement cleaning a vertical stovepipe.

Referring to FIG. 6, to scrub the vertical stovepipe 12, handle 38 is pivotally elevated at third opening 22 to permit brush 34 to pass through bottom first opening 16. Flexible shaft 37 bends as brush 34 enters vertical pipe 12. The pliable bag 30 allows shaft 37 to take this angled position without breaking the seal for mouth 31 about the opening 22 and allowing waste particles to escape. Reciprocating and rotational motion of shaft 37 is again commenced so that wire bristles 35 scrub vertical stovepipe 12. The waste particles settle and fall into firebox 6 or ash drawer 8.

When scrubbing is completed, brush 34 is withdrawn from the conduiting into bag 30. The fastening means 36 are disengaged and mouth 31 is slid off opening 22. Mouth 31 then substantially closes to confine and catch any loose soot and dust that may fall off brush 34 during storage of assembly 28. Cap 24 is replaced onto opening 22 in preparation for resuming combustion in the stove 4. All freed waste particles that have settled may be removed from the chimney base through a clean-out door and from the stove 4 by emptying ash drawer 8.

The present invention may be embodied in other specific forms without departing from the spirit or essential attributes thereof. The illustrated embodiment should be considered in all respects as illustrative and not restrictive, reference being made to the appended claims rather than to the forgoing description to indicate the scope of the invention.

That which is claimed is:

1. An economical stovepipe cleaning apparatus arrangement including a wholly removable bag and brush assembly for providing fast, convenient and dust-free brush cleaning of stovepipe conduiting of a combustion stove without a need for any disassembly of the conduiting to accomplish said cleaning, and the arrangement further comprising (a) a T-shaped stovepipe joint having opposed first and second openings and a transversely oriented third opening, (b) a vertical stovepipe from a combustion stove connected to the third opening, (c) a horizontal stovepipe connected to the first opening, (d) said bag and brush assembly consisting of a pliable bag about a stovepipe scrubbing brush with an attached flexible shaft, the bag having a close-fitting aperture and a mouth in opposed relationship and being symmetrical therebetween, said mouth being removably attached to said second opening, said shaft being slidably received within said aperture, whereby said bag blocks exit of loose soot and dust from said stovepipes while employing the brush to scrub the interior of the conduiting of said joint and said stovepipes, said bag being further characterized in that it functions as an envelope just sufficiently large to accomodate said brush and confine soot and dust that may fall off said brush during times of storage of said assembly after removal of the same from said second opening, and (e) a cap for closing the second opening when said bag and brush assembly is removed from said second opening during times of combustion within the stove.

2. The assembly of claim 1, wherein said mouth is elastic.

3. The assembly of claim 1, wherein said mouth has a fastening means for sealing said mouth about said second opening.

4. A fast, convenient and dust-free method of brush-cleaning stovepipe conduiting requiring no disassembly of any of the conduiting of the stovepipes, wherein the stovepipe apparatus arrangement comprises (a) a T-shape joint having opposed first and second openings and a transversely oriented third opening, (b) a vertical stovepipe from a combustion stove connected to the third opening, (c) a horizontal stovepipe connected to the first opening, (d) a cap normally closing the second opening during times of combustion in the stove but readily removable for cleaning, and (e) a bag and brush assembly consisting of a pliable bag about a stovepipe scrubbing brush with an attached flexible shaft, the bag having a close-fitting aperture and a mouth in opposed relationship and being symmetrical therebetween, said shaft being slidably received within said aperture, said bag being further characterized in that it functions as an envelope just sufficiently large to accommodate said brush and confine soot and dust that may fall off said brush during times of storage of said assembly, said method comprising (i) removing said cap from said second opening during a time when combustion in the stove is nominal or completely extinguished, (ii) fastening said assembly at the mouth thereof to said second opening with said bag extending substantially horizontally from said opening and not in a soot-collecting depending manner therefrom, and with said brush within said bag and the shaft of said brush extending through said aperture, (iii) scrubbing the interior of said conduiting of said joint and stovepipes by reciprocating and rotational motion of said shaft and brush in a manner causing the soot and dust to be removed therefrom and fall into the stove or the base portion of a chimney but without substantially withdrawing the same into said bag, (iv) withdrawing said brush into said bag, (v) disengaging said assembly from said second opening and storing the same with the brush enveloped by the bag thereof and the mouth of the bag in a substantially closed condition, and (vi) replacing said cap onto said second opening in preparation for resuming combustion in the stove.

* * * * *